US008783508B2

(12) United States Patent
Comerford

(10) Patent No.: US 8,783,508 B2
(45) Date of Patent: Jul. 22, 2014

(54) WALL MOUNTED TISSUE PRESS WITH INTEGRATED TISSUE DISPENSER

(76) Inventor: William P. Comerford, Victoria (CA)

( * ) Notice: Subject to any disclaimer, the term of this patent is extended or adjusted under 35 U.S.C. 154(b) by 130 days.

(21) Appl. No.: 13/298,497

(22) Filed: Nov. 17, 2011

(65) Prior Publication Data

US 2012/0228322 A1 Sep. 13, 2012

Related U.S. Application Data

(60) Provisional application No. 61/414,795, filed on Nov. 17, 2010.

(51) Int. Cl.
*B30B 1/00* (2006.01)

(52) U.S. Cl.
USPC ..... 221/96; 100/227; 100/215; 100/217

(58) Field of Classification Search
USPC ..... 221/102; 100/215, 217, 226, 227, 240, 100/245
See application file for complete search history.

(56) References Cited

U.S. PATENT DOCUMENTS

| | | | | | |
|---|---|---|---|---|---|
| 1,915,522 | A * | 6/1933 | Fred | 221/34 |
| 2,415,588 | A * | 2/1947 | Gui | 206/233 |
| 3,072,245 | A * | 1/1963 | Faltin | 224/277 |
| 3,414,157 | A * | 12/1968 | Wright | 220/521 |
| 4,519,308 | A * | 5/1985 | Eberle | 100/102 |
| 6,152,079 | A * | 11/2000 | Chandler | 119/161 |
| 6,170,692 | B1 * | 1/2001 | Johnston | 220/475 |
| 6,364,156 | B1 * | 4/2002 | Smith et al. | 221/46 |
| D460,233 | S * | 7/2002 | Strubin | D34/1 |
| 6,702,147 | B2 * | 3/2004 | Ashford | 221/34 |
| 7,490,764 | B2 * | 2/2009 | Clark | 235/383 |
| 8,302,810 | B2 * | 11/2012 | Mulhem et al. | 221/34 |
| 2005/0257698 | A1 * | 11/2005 | Fukuizumi et al. | 100/233 |
| 2006/0151519 | A1 * | 7/2006 | White | 221/63 |
| 2007/0045333 | A1 * | 3/2007 | Mitchell et al. | 221/34 |
| 2007/0283490 | A1 * | 12/2007 | Wilt | 4/661 |
| 2009/0223993 | A1 * | 9/2009 | Lorenzati | 221/35 |
| 2010/0327000 | A1 * | 12/2010 | Winslow et al. | 221/1 |

* cited by examiner

*Primary Examiner* — Patrick Mackey
(74) *Attorney, Agent, or Firm* — Davis & Bujold, PLLC; Michael J. Bujold

(57) ABSTRACT

A wall-mounted tissue press that combines a dispenser and receptacle into one integrated unit that dispenses, receives, compacts and temporarily stores, tissue paper. By a combination of internal components, a ram is created to compress stored waste, and effectively increase the capacity of said receptacle.

3 Claims, 12 Drawing Sheets

WALL MOUNTED TISSUE PRESS WITH INTEGRATED TISSUE DISPENSER

CROSS-REFERENCE TO RELATED APPLICATIONS

This application claims the benefit of U.S. Patent Application No. 61/414,795 filed in the U.S. Patent and Trademark Office on Nov. 17, 2010 by the same inventor.

FEDERAL FUNDING

N/A

FIELD OF THE INVENTION

This invention relates to receptacles and more particularly to a wall supported container and specifically to a wall mounted tissue press with integrated dispenser.

BACKGROUND OF THE INVENTION

Personal hygiene is becoming increasingly important in an age where many bacteria and virus are resistant to modem disinfectants and drugs. Hands often act as vectors that carry disease-causing pathogens from person to person, either through direct contact or indirectly via surfaces. Humans can spread bacteria by touching other people's hand, hair, nose, and face. Hands that have been in contact with human or animal feces, bodily fluids like nasal excretions, and contaminated foods or water can transport bacteria, viruses and parasites to unwitting hosts.

Another common transmission vector for pathogens is by indirect contact by touching door knobs, tissues and handkerchiefs previous touched by an infected individual. Common infective organisms are almost always present in our surroundings. Hand-washing with soap is among the most effective and inexpensive ways to prevent diseases such as diarrheal diseases and pneumonia, which together are responsible for a significant number of deaths. Hand washing with soap works by interrupting the transmission of disease.

Studies have shown that effective hand-washing with non-medicated soap removes bacteria. For effective hand-washing with non-medicated soap, rubbing together of lathered hands for 8-15 seconds, followed by thorough rinsing with running water, and finally drying by at least two paper towels were recommended. Paper and not cloth towels should be available.

Door knobs are one of the most frequently touched objects in modern society. An individual may come into contact with dozens of door knobs during a day and these door knobs most likely have been touched previously by several individuals. Door knobs are a common repository of communicable pathogens. Door knobs on the doors of public washrooms can be very contaminated since it is known than many individuals, up to 30% of the travelling public, do not wash their hands after using the washroom. Therefore, there is a requirement to provide means for individuals who do wash their hands to avoid contact with a contaminated door knob or handle.

A few solutions have been proposed. For example, one solution is to provide for a foot operated door opener that requires no hand contact. However, such an opener can scuff and damage shoes and may not be suitable for all persons. Another solution is to provide a motion activated door opener that opens when an individual waves a hand in front of a sensor. Such devices are very expensive and so installation in public washrooms may not be practical.

US patent application number 20100003174 describes a "Golden touch container system" wherein an electro-mechanical device disinfects the door knob after every use. Such a device would be expensive to install.

U.S. Pat. No. 7,757,351 for a "sanitary tissue and tissue dispenser for door knobs" describes a tissue dispensing device that fits around door knobs. The device dispenses tissues that are used by an individual to open the door without having to contact the door knob directly. Such a device may not hold sufficient tissues for a busy washroom.

Therefore, there is a continued requirement for devices and apparatus to encourage individual hygiene and dispense a suitable prophylactic to prevent contact with door knobs and other contaminated surfaces in public washrooms.

SUMMARY OF THE INVENTION

The invention is a wall mounted tissue press with an integrated tissue dispenser and used tissue receptacle comprising a space enclosing member having a closable top side, a closable bottom side and a closable back side. The back side member is mounted the closable back side by mounting means and to an adjacent wall surface by the same mounting means thereby forming a rectangular hollow receptacle for receiving waste tissue. The back side member can also be adhesively mounted to the wall.

The top door for temporarily closing the closable top side is mounted by a top hinge member to the back side member. The bottom door for temporarily closing the closable bottom side is mounted by a bottom hinge member to the back side member. Clean tissue in a box is stored within the receptacle and dispensed from the receptacle. The invention also comprises a used tissue compression means that is stowed within the used tissue receptacle.

In one embodiment of the apparatus of the invention the space enclosing member, the top door and the bottom door are fabricated from stainless steel; however other suitable materials can be used. Stainless steel has aesthetic and septic qualities.

The top door further comprises a left side and a right side and a first aperture having a first perimeter surrounded by a first collar. The top door aperture receives waste tissue. The top door forms an isosceles trapezoid having a shorter base forward and a longer base rearward. The top door also has a left side flap comprising a vertical downward first irregular pentagon having a base side along the door left side; and, a right side flap comprising a vertical downward second irregular pentagon identical to the first irregular pentagon having a base side along the door right side.

In one embodiment of the apparatus the top surface of the top door is angled downwards between 15 degrees and 20 degrees from a horizontal when in the closed position. When the top door is open it is vertical. The top door remains in the closed position using a latch member comprising a pin and aperture.

The bottom door further comprises a left side and a right side forming an isosceles trapezoid having a shorter base forward and a longer base rearward. The bottom door further includes a left side flap comprising a vertical upward first irregular pentagon having a base side along the bottom door left side; and, a right side flap comprising a vertical upward second irregular pentagon identical to the first irregular pentagon having a base side along the bottom door right side.

In one embodiment of the invention when the bottom door is closed it is angled upwards between 15 degrees and 20 degrees from the horizontal. When the bottom door is open it is vertical.

The space enclosing member comprises a single sheet of material formed into a front surface, a left-side surface, a right-side surface, a left-side rear mounting flange and a right-side rear mounting flange. The left-side surface and the right-side surface angle inwards to join the front surface. This gives the storage receptacle a trapezoidal appearance in cross-section. The front surface includes a second aperture having a second perimeter surrounded by a second collar wherein said second aperture dispenses clean tissues. The second aperture is disposed about five inches downward from the shorter base of the top door.

In one embodiment of the apparatus the tissue compression means comprises a ram member having a base member, a second member rising from said base member, a first angled member rising at a first angle from said second member and a second angled member depending away from the first angled member at a second angle. When the ram member is in a stowed position the base member is horizontal, the second member is vertical, the first angled member rises at an angle of about 40 degrees up from the horizontal and the second angled member depends downward at about 50 degrees from the horizontal. When in the stowed position the ram first angled member and the second angled member join at a right angle and this right angle suspends the ram member over a top edge of said front surface. The ram member forms said clean tissue storage and dispensing means. The clean tissue storage means comprises a cavity within the receptacle having a base member comprising the base member of the ram and a cavity back support member comprising the second vertical member of the ram. The cavity accepts placement of a box of clean tissues having a clean tissue dispensing slot aligned with dispensing means comprising the second aperture.

When a box of clean tissues within the cavity is empty, the top door is opened and the ram is removed from the receptacle by a custodian. The custodian removes the empty box of tissues and grasps the right angle like a handle to apply a compressive force to used tissue within the receptacle using the ram base member thereby increasing storage within the receptacle. A new box of tissue is placed within the cavity and the ram member is placed in its stowed position.

DESCRIPTION OF THE INVENTION

The following description of the present invention is merely exemplary in nature and not intended to limit the invention or the application or uses of the invention.

Figure 1:
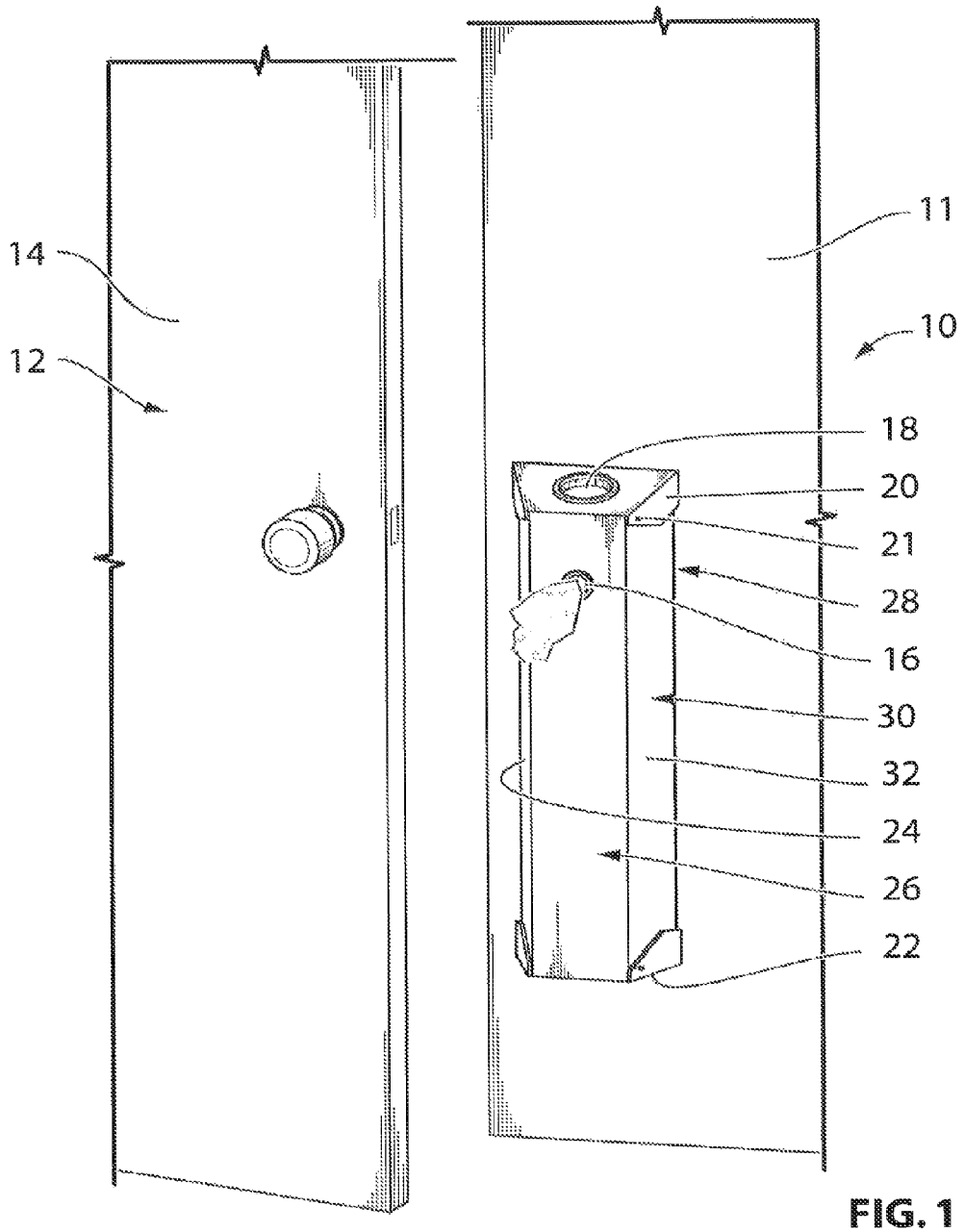
FIG. 1 illustrates one embodiment of the invention mounted to a wall near a door.

Referring to FIG. 1 there is illustrated one embodiment of the invention 10 which is an integrated unit comprising a wall mounted tissue press with an integrated tissue dispenser and used tissue receptacle. The unit is mounted on wall 11 proximate to door 12 and door knob 14. The invention 10 comprises a clean tissue dispenser 16 combined with a trash receptacle having orifice 18. Within the invention is a tissue press the operation of which is more fully explained below.

The top of the invention comprises a top pivoting door 20 which opens to replace the clean tissue box. (Not shown in this Figure. Refer to FIG. 4). The door 20 is held in place by a latch 21 the operation of which is more fully described below. The bottom of the invention 10 comprises a bottom pivoting door 22 that opens to discharge discarded tissues into a suitable trash container such as a bag. The body of the invention 24 is a four-sided receptacle having a front surface 26 parallel to a rear surface 28. The front surface 26 is narrower than the rear surface 28. The rear surface 28 is mounted flush to wall 11. The side surface 30 and side surface 32 are angled inward from rear surface 28 to front surface 26 so that the body is generally in the form of a trapezoid. The top door 20 is angled downwards and the bottom door 22 is angled upwards.

Figures 2A, 2B:
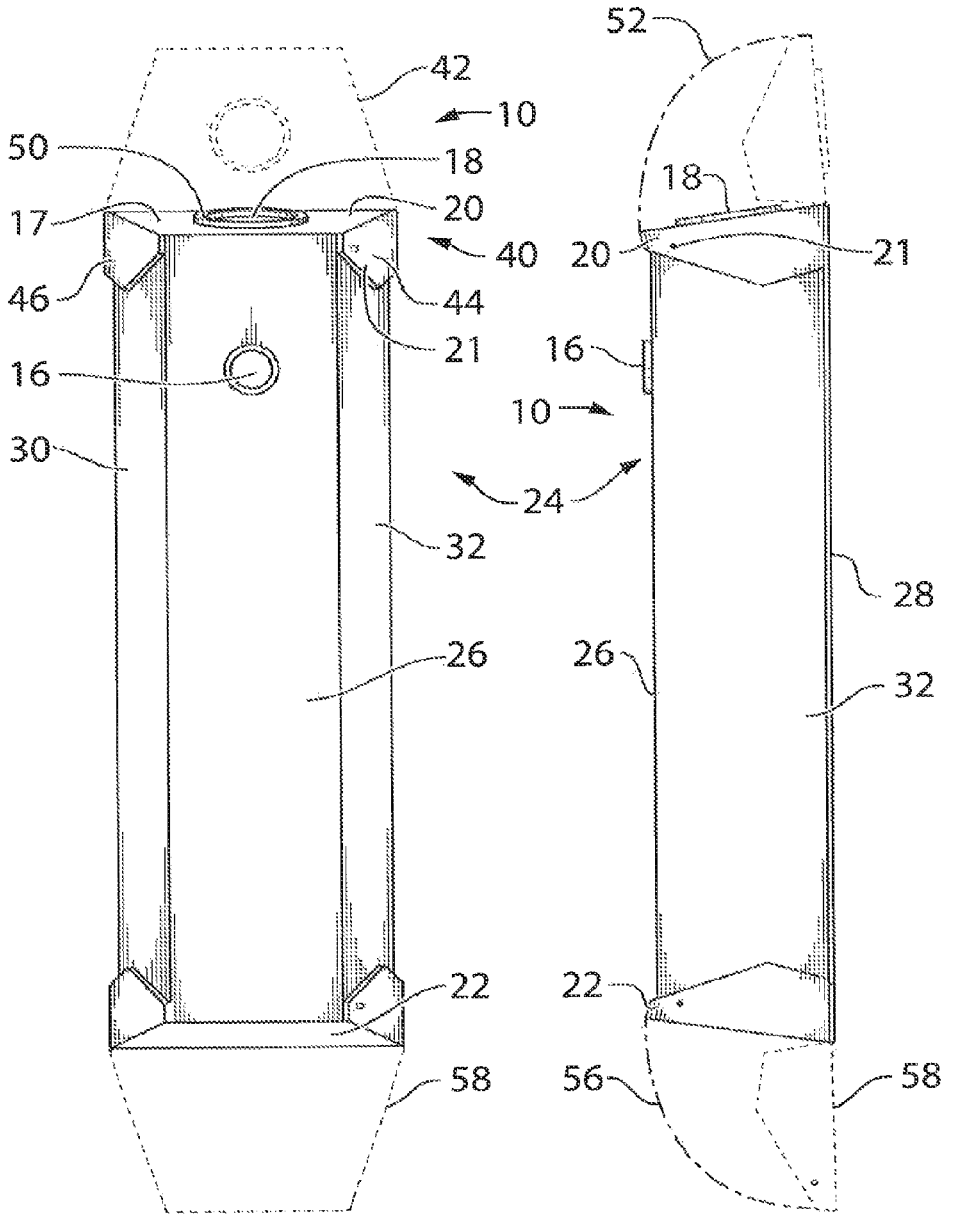
FIG. 2*a* is a front view of one embodiment of the invention.
FIG. 2*b* is a side view of one embodiment of the invention.

Referring to FIG. 2A and FIG. 2B, there is shown one embodiment of the invention 10 in front view (FIG. 2A) and side view (FIG. 2B). In the front view, the invention 10 comprises a top door 20 having a first closed position 40 and a second open position 42. Latch 21 keeps the door closed. The door 20 comprises a top surface 17 trash receptacle orifice 18, right side flap 44 and left side flap 46. The orifice 18 includes a collar 50 to cover the sharp edge of the orifice 18 and prevent used tissues from snagging on any sharp edge. The body of the invention 24 is a trapezoidal-shaped receptacle comprising a front surface 26, a left side surface 30, a right side surface 32 and a rear surface 28. As shown in the side view of FIG. 2B, the top door 20 pivots upwards through path arc 52 to a vertical position 42 and the bottom door 22 pivots downwards through path arc 56 to a vertical position 58.

Figure 3:
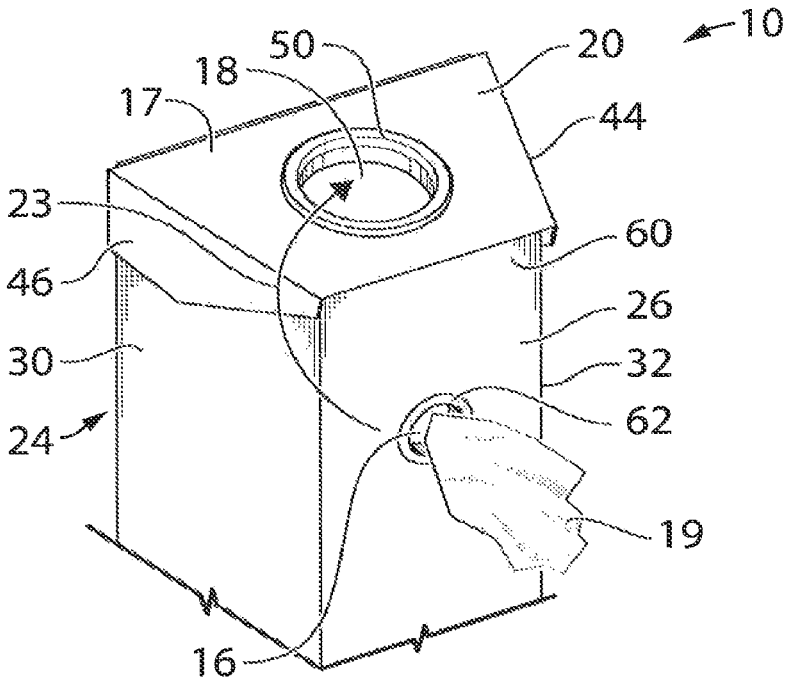
FIG. 3 is perspective view of a top portion of the body of one embodiment of the invention.

Referring now to FIG. 3, there is shown one embodiment of the invention 10 top portion comprising top door 20 having a slanted top surface 17, trash orifice 18 having a collar 50, left-side door flap 46 and right-side door flap 44. The front surfaces of the door flaps extend slightly beyond the front surface 26 of the body 24 so that the door can be grasped and opened using the front overhang portion 60. The door 20 is held close by a latch 21 on right-side flap 44 and a close press fit between left-side flap 46 and body side 30 and right-side flap 44 and body side 32. Also illustrated is clean tissue 19 dispensing orifice 16 having a collar 62. Arrow 23 illustrates the cycle of the clean tissue from the dispensing orifice 16 to the trash orifice 18.

Figure 4A:
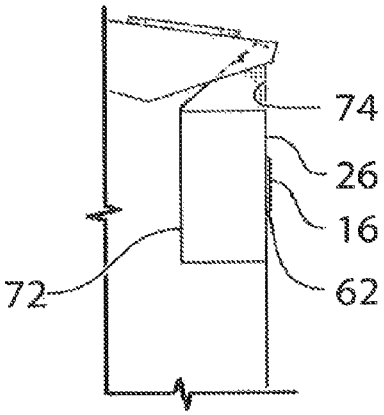
FIG. 4*a* is a side view, in partial section, of one embodiment of the invention.
Figure 4B:
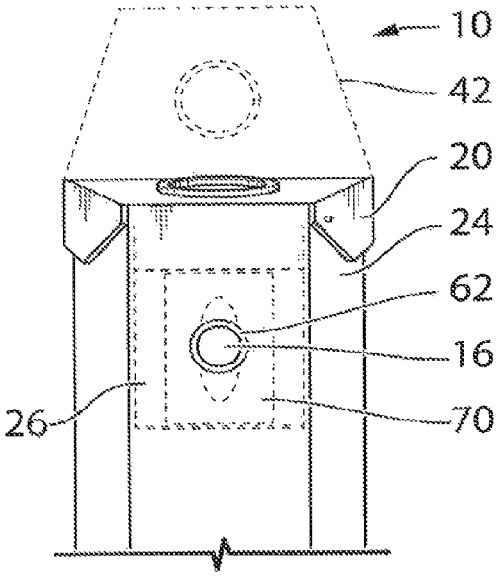
FIG. 4*b* is a front view, with hidden lines, of one embodiment of the invention.

Referring now to FIG. 4A and FIG. 4B, there is shown a side view and front view, respectively, of the top portion of the body 24 of the invention 10. The tissue box holder 70 for holding a container 71 or magazine of clean tissues is disposed into a tissue box holder 72 disposed on the inside surface 74 of the front surface 26 of the body. The tissue dispensing orifice 16 and collar 62 within the front wall 26 of the receptacle are disposed adjacent the opening in a tissue container 71 so that tissues can be easily extracted from the container. The tissue box holder 70 is accessed by opening door 20 and moving the door to its vertical position 42. The tissue box container 71 slides easily into the tissue box holder 70 and then the top door 20 can be closed and latched into a closed position by latch 21.

Figure 5:
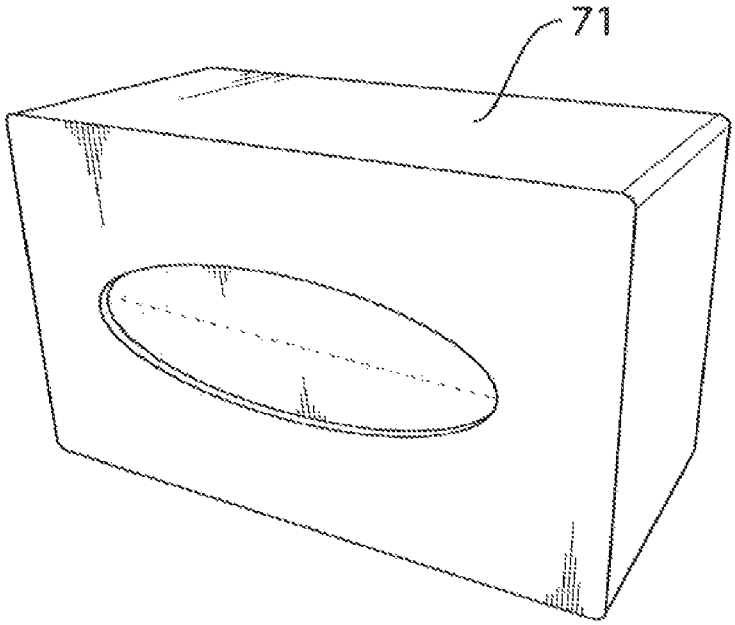
FIG. 5 is a view of the tissue box of one embodiment of the invention.

FIG. 5 illustrates a preferred type of tissue container being Kimtissues® by Kimberley-Clark® (Trademarks) having the appropriate dimensions to fit within the tissue box 70.

Figure 6:
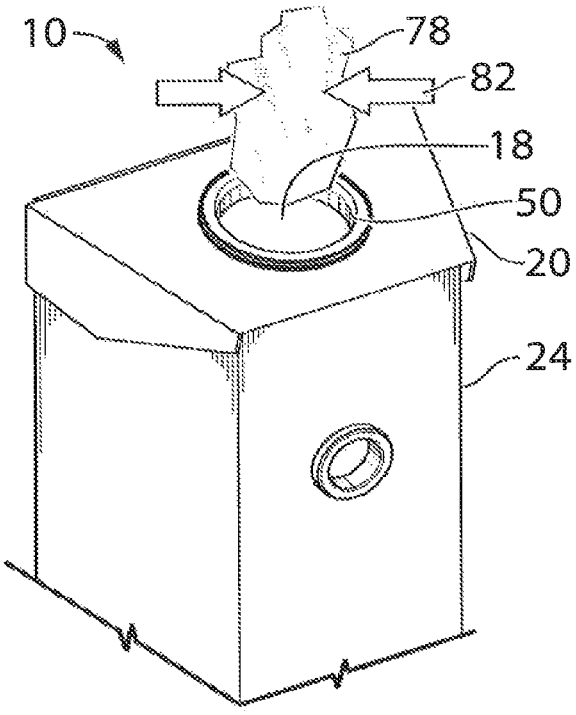
FIG. 6 is a perspective top view of one embodiment of the invention showing the top door orifice.

Referring now to FIG. 6, there is shown a view of the top portion of the invention 10 comprising the body 24 and top door 20 having trash disposal orifice 18 and collar 50. Once the tissue 78 is used by a person to touch a door handle it can be disposed of by compressing it as shown by arrows 82 and placing it into the trash disposal orifice 18 whereupon it will fall to the bottom of the receptacle.

Figure 7:
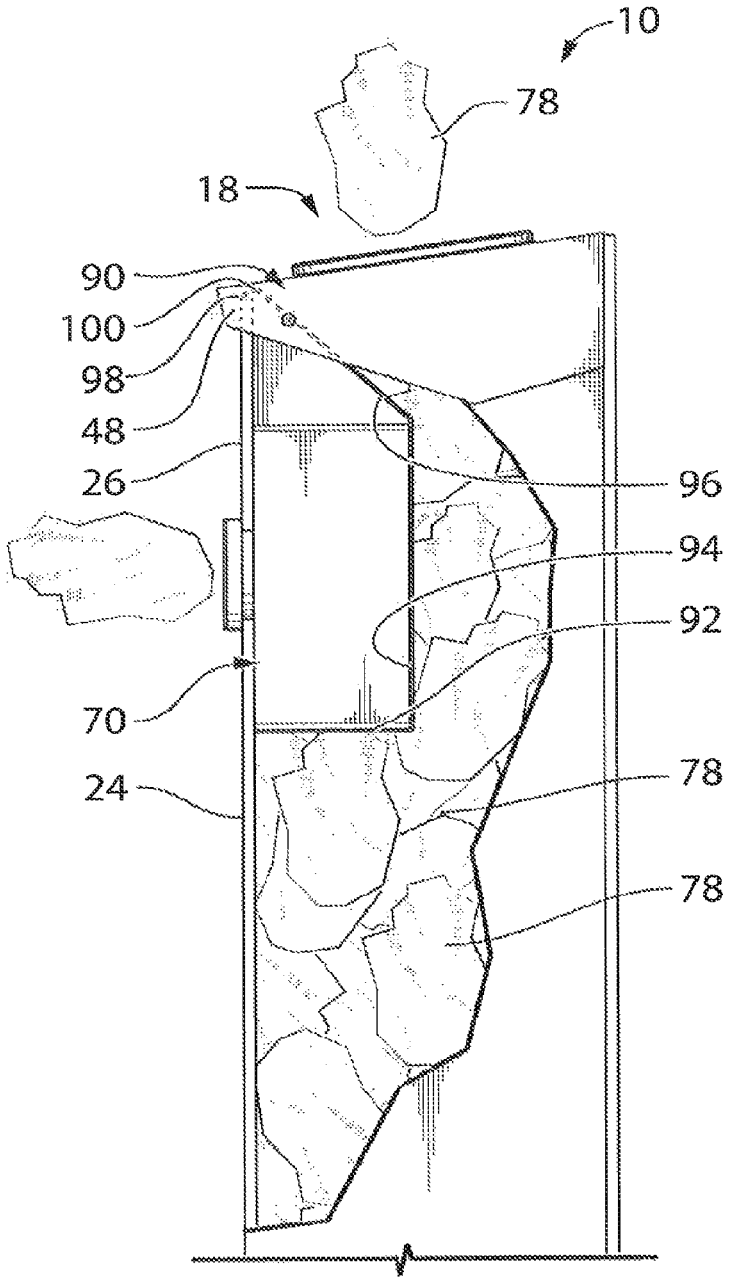
FIG. 7 is a side view, in partial section, of one embodiment of the invention showing the used tissues accumulating therein.

Referring now to FIG. 7, there is shown the invention 10 in a cross-sectional side view. Used tissues 78 are represented by the hexagon shapes. As the receptacle 24 fills, the tissues 78 are disposed in a loose configuration as shown within the receptacle. This arrangement does not constitute an effective use of the limited storage space available within the receptacle and so the invention additionally comprises a ram 90 which is also the tissue container 71 holder 70 when it is in its stored position as described below. In its stored position as shown in FIG. 7, the ram 90 comprises a bottom horizontal member 92, a vertical member 94, an inclined member 96 and an opposite-inclined member 98. The inclined member 98 hangs the ram from the top edge 100 of front surface 26. Inclined member 96 deflects waste material 78 away from the tissue container 71 so that discarded tissues will not collect above the ram member 90.

Figure 8:
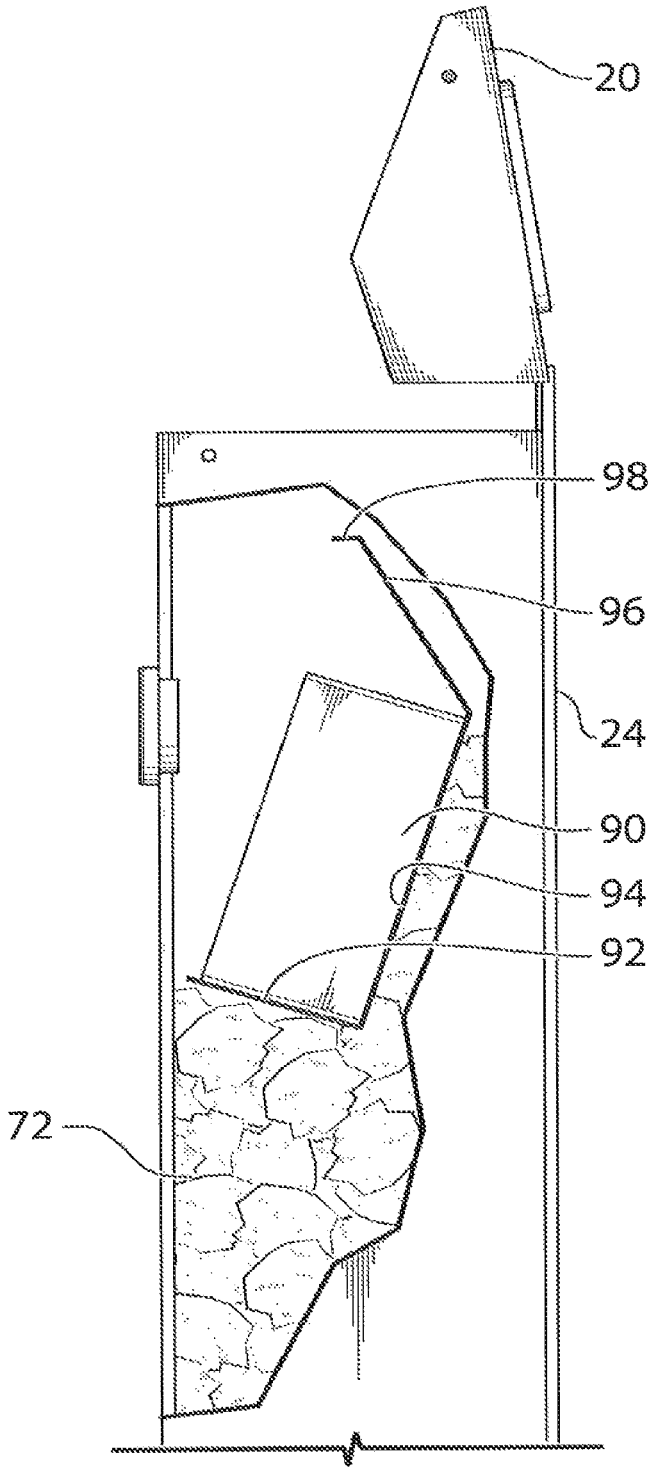
FIG. 8 is a side view, in partial section, of one embodiment of the invention showing the ram.

Referring to FIG. 8, the ram 90 is accessed by opening the top door 20. An operator will remove the ram 90 from its stored position and the container of tissues held therein as shown in FIG. 7 and grasp it by inclined members 96 and 98 which form a handle. Bottom ram member 92 and side ram member 94 are used to compress the waste material 72 down to the bottom of receptacle 24. This can be done periodically by a custodian to prevent the receptacle from filling up prematurely. Once the used tissues are compressed to the bottom of the receptacle the ram member can be placed in its stored and hanging position as shown in FIG. 7.

Figure 9:
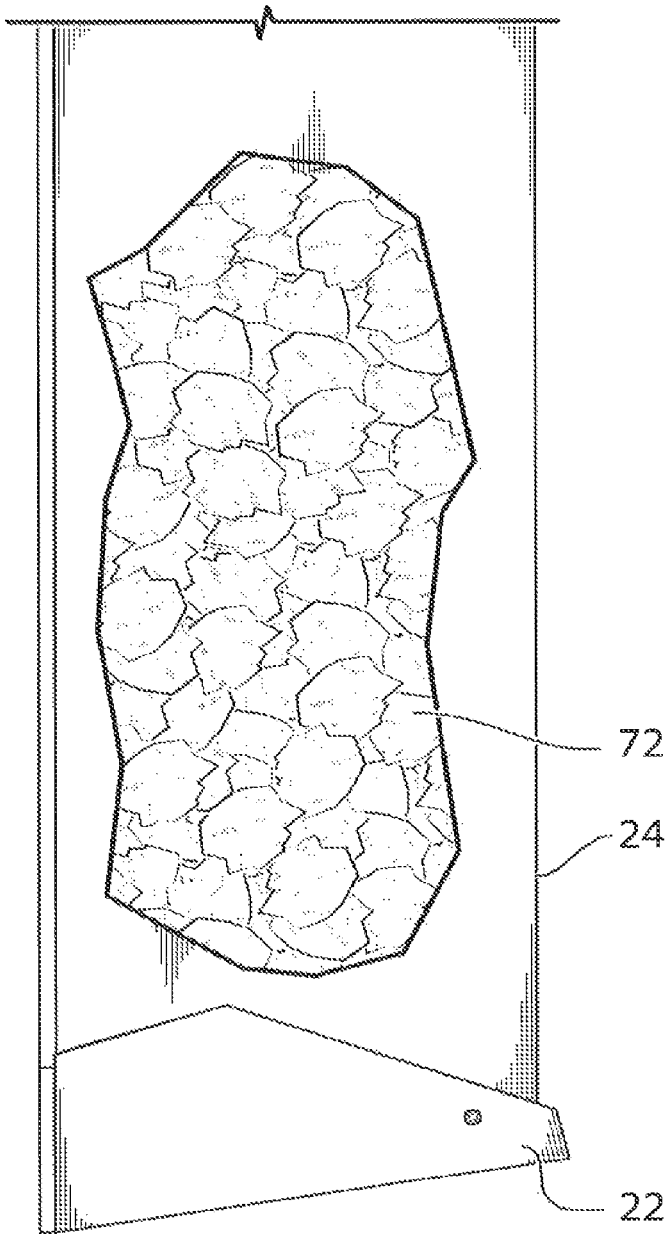
FIG. 9 is a side view, in partial section, of one embodiment of the invention showing the discarded tissues compacted in the bottom of the body.

Referring to FIG. 9, the result of compressing the waste material 72 to the bottom of the receptacle 24 is that the material is adjacent to bottom door 22 for convenient disposal.

Figure 10:
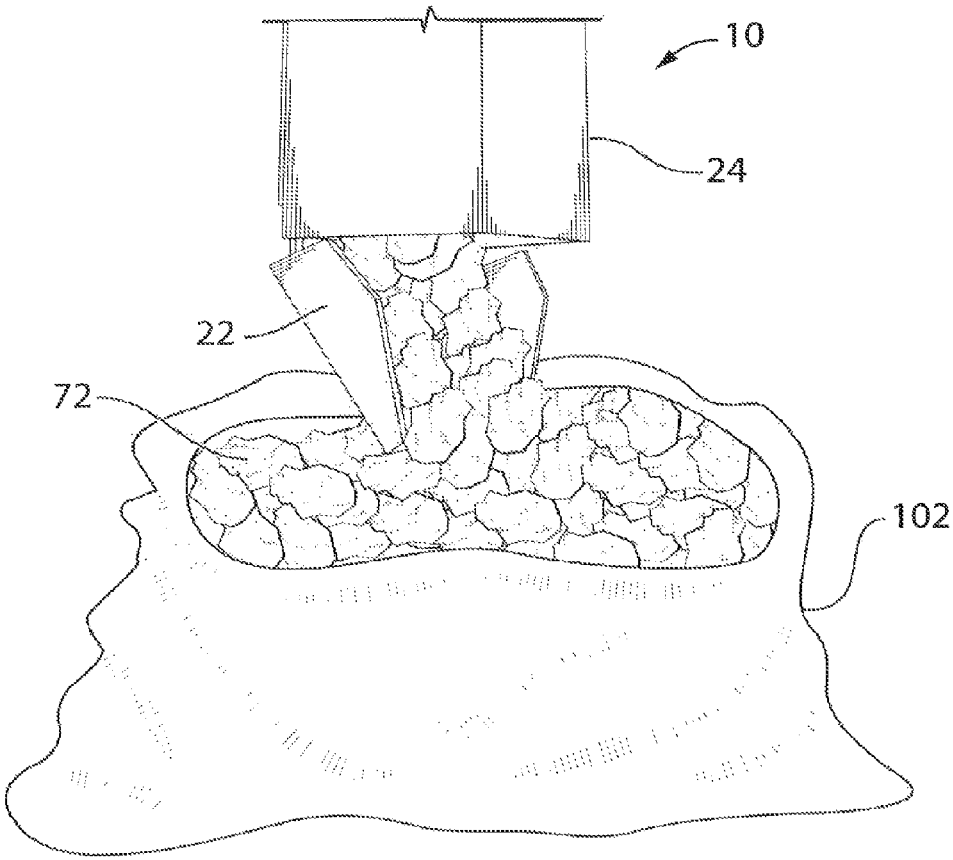
FIG. 10 is a view of one embodiment of the invention showing the waste being emptied into a garbage bag.

Referring to FIG. 10 there is shown the bottom portion of the invention 10 with the bottom door 22 in an open position. Bag 102 is placed below the opening for receiving compressed waste material 72. Conveniently because the waste material has been compacted by the ram, it will decompress as soon as the bottom door 22 is opened and easily drop into the waste bag 102 without the operator having to insert his or her hand into the receptacle and pull the material out.

Figure 11:
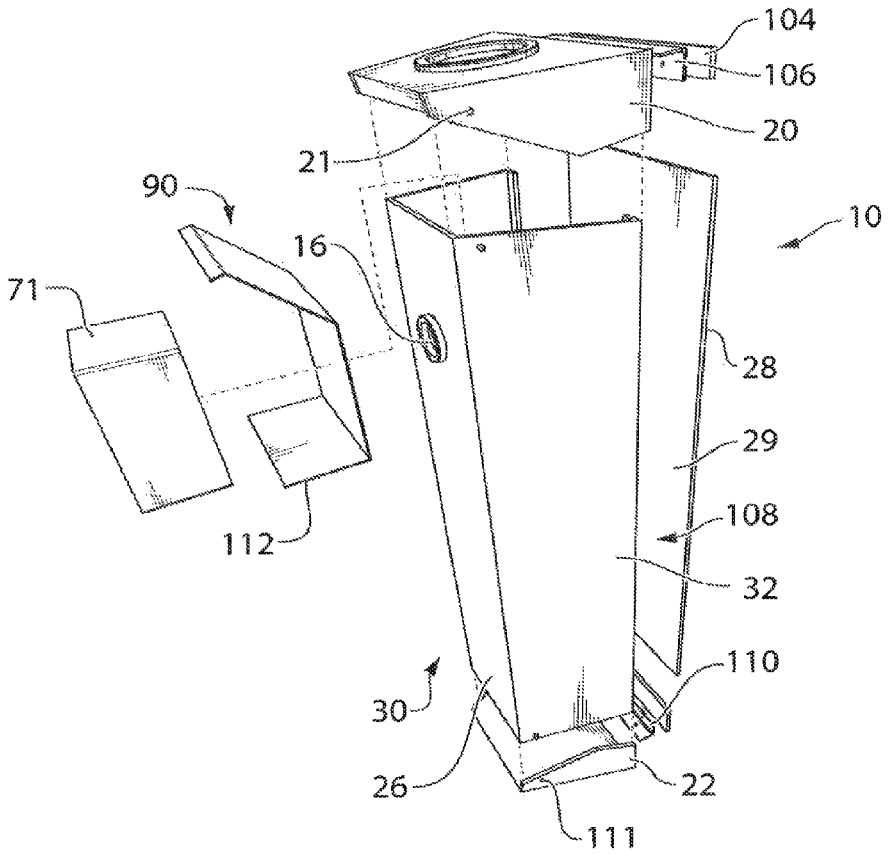
FIG. 11 is an exploded front perspective assembly drawing of one embodiment of the invention.
Figure 12:
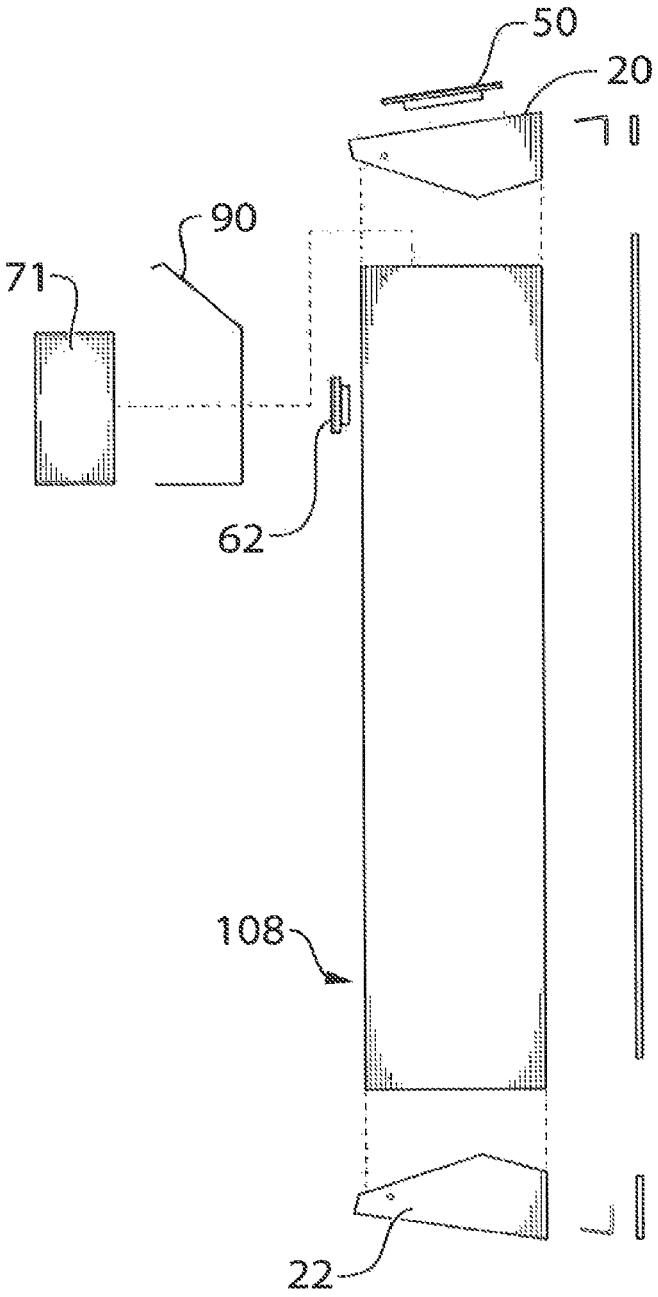
FIG. 12 is an exploded side assembly view of one embodiment of the invention.

Referring now to FIG. 11 and FIG. 12, there is shown front view and side view assembly diagrams respectively of one embodiment of the invention 10 comprising the following components: a rear member 28 for wall mounting through orifices 29. The rear member 28 may also be adhesively mounted to a wall by adhesive member 104. At the top end of the rear member is attached a hinge member 106 for mounting the top door 20 having latch 21. The front 25 panel 108 of the body 24 comprises sides 30 and 32 and front face 26 having dispensing orifice 16. The bottom of the rear member mounts hinge member 110 for mounting bottom door 22 having a latch 111. Within the assembled body 24 is mounted tissue ram 90 within which a tissue container 71 is held when the ram 90 is in its stored position.

What is claimed is:

1. A wall mounted tissue press comprising:

a body defining a waste receptacle, the body having a top side, and a bottom side;

a top door for temporarily closing said top side, and the top door having a receptacle port for receiving waste tissue;

a bottom door for temporarily closing said bottom side;

a tissue dispenser; and a tissue compression device positioned within said waste receptacle;

wherein the body includes a dispensing port in communication with the tissue dispenser for dispensing tissue; and the waste receptacle forms a channel to guide the tissue compression device stored within.

2. The wall mounted tissue press apparatus of claim 1 wherein the tissue dispenser is suspended on a hanger within the waste receptacle.

3. The wall mounted tissue press apparatus of claim 2, wherein the tissue compression device comprises the hanger and the tissue dispenser combined to form a ram to compress used tissue stored in the waste receptacle.

* * * * *